US008627619B2

(12) United States Patent
Heaney

(10) Patent No.: US 8,627,619 B2
(45) Date of Patent: Jan. 14, 2014

(54) RIGGING DECK MODULE

(75) Inventor: David Heaney, Tewantin (AU)

(73) Assignee: Decklite IP Holdings Limited, Mahe (SC)

( * ) Notice: Subject to any disclaimer, the term of this patent is extended or adjusted under 35 U.S.C. 154(b) by 30 days.

(21) Appl. No.: 12/997,550

(22) PCT Filed: Jun. 10, 2008

(86) PCT No.: PCT/AU2008/000819

§ 371 (c)(1),
(2), (4) Date: Mar. 1, 2011

(87) PCT Pub. No.: WO2009/117758

PCT Pub. Date: Oct. 1, 2009

(65) Prior Publication Data

US 2011/0302868 A1 Dec. 15, 2011

(51) Int. Cl.
*E04B 1/00* (2006.01)

(52) U.S. Cl.
USPC ..... 52/222; 52/582.1; 52/664; 52/83; 52/273

(58) Field of Classification Search
USPC ..... 52/582.1, 650.3, 660, 664, 3, 4, 5, 83, 52/273, 782.22, 222, 223.1, 223.6, 231, 52/291; 182/138
See application file for complete search history.

(56) References Cited

U.S. PATENT DOCUMENTS 3,527,319 A * 9/1970 Pedley ..... 182/139
3,949,834 A * 4/1976 Nusbaum ..... 182/138
4,068,738 A * 1/1978 Reed ..... 182/128
4,074,791 A * 2/1978 Inman ..... 182/138
4,389,141 A * 6/1983 Cumings ..... 405/211
4,856,615 A * 8/1989 Nusbaum ..... 182/82
4,892,169 A * 1/1990 Duncan ..... 182/138
4,982,813 A * 1/1991 Starr ..... 182/138
4,986,389 A * 1/1991 Halligan et al. ..... 182/138
5,161,641 A * 11/1992 Nusbaum ..... 182/138
5,197,239 A * 3/1993 Glynn et al. ..... 52/63
5,299,654 A * 4/1994 Duncan ..... 182/138
5,579,610 A * 12/1996 Jackson ..... 52/4
5,673,769 A * 10/1997 Rexroad et al. ..... 182/138
5,778,613 A * 7/1998 Thomson ..... 52/222
5,787,955 A * 8/1998 Dargie ..... 160/368.1
5,795,267 A * 8/1998 Weaver ..... 482/35
5,848,665 A * 12/1998 Rexroad et al. ..... 182/138
6,035,967 A * 3/2000 Maeda ..... 182/138
6,068,085 A * 5/2000 Denny et al. ..... 182/138
6,098,750 A * 8/2000 Reynolds et al. ..... 182/138

(Continued)

FOREIGN PATENT DOCUMENTS

DE 2551594 A1 5/1976
GB 2193240 A 2/1988

*Primary Examiner* — William Gilbert
*Assistant Examiner* — James Ference
(74) *Attorney, Agent, or Firm* — The Culbertson Group, P.C.

(57) ABSTRACT

A rigging deck module including: a deck body including a flexible deck material bounded by a web-reinforced tensile edge, suspension means spaced about the edge whereby the deck body is tensionable to form a substantially flat deck surface, and a lattice of tensile web members secured to the flexible deck material and the web-reinforced tensile edge; tensile rigging strops adapted to be mounted in tension to a structure in maintained spaced relation to each other, and each having securing points formed thereon; and tensionable connection means located at each suspension means for securing and tensioning the deck body to the respective securing points.

8 Claims, 4 Drawing Sheets

(56) References Cited

U.S. PATENT DOCUMENTS

| | | | | |
|---|---|---|---|---|
| 6,161,648 | A * | 12/2000 | Rexroad et al. | 182/138 |
| 6,182,790 | B1 * | 2/2001 | Denny et al. | 182/138 |
| 6,186,274 | B1 * | 2/2001 | Reynolds et al. | 182/138 |
| 6,305,310 | B1 * | 10/2001 | Ferri | 114/343 |
| 6,698,604 | B2 * | 3/2004 | Denny et al. | 211/189 |
| 6,776,260 | B2 * | 8/2004 | Cjepa | 182/138 |
| 7,169,718 | B1 * | 1/2007 | Rexroad | 442/1 |
| 7,448,836 | B2 * | 11/2008 | Clarke et al. | 410/97 |
| 2002/0020584 | A1 * | 2/2002 | Cjepa | 182/138 |
| 2002/0104710 | A1 * | 8/2002 | Thompson et al. | 182/138 |
| 2003/0075385 | A1 * | 4/2003 | Walls et al. | 182/138 |
| 2004/0079586 | A1 * | 4/2004 | Walls et al. | 182/138 |
| 2006/0090961 | A1 * | 5/2006 | Rexroad | 182/138 |
| 2006/0201744 | A1 * | 9/2006 | Curtis et al. | 182/138 |
| 2006/0213724 | A1 * | 9/2006 | Rexroad | 182/138 |

* cited by examiner

RIGGING DECK MODULE

FIELD OF THE INVENTION

The invention relates to a rigging deck module. This invention has particular application to a rigging deck module used for maintenance of offshore oil platforms and the like, and for illustrative purposes the invention will be further described with reference to this application. However, it is envisaged that this invention will find other applications, such as rigging decks for other structures such as buildings and bridges.

PRIOR ART

Rigging for oil rig maintenance and the like must be demountable for redeployment and storage, while providing as safe a working environment as possible in an inherently dangerous rigging situation. The sheer heights involved mandate either or both of securing rigging to the upright structure of the rig or suspending the rigging from the working platform of the rig. In the past there have been applied many technical solutions, some of which can be regarded as commonplace or standard and others of which are ad hoc solutions to local technical problems.

Fixed scaffolding represents the most conventional form of temporary rigging for maintenance of structures generally. Oil platforms have widely spaced piers rather than a wall supported on the ground and so present fewer attachment points that are accordingly subjected to higher loadings. The complexity of the assembly increases as the distance from the fixed support increases. Accordingly, suspended apparatus is preferred.

Suspended rigid platforms are analogous to the working platforms suspended from davits and used for external maintenance and cleaning of high rise buildings and the like. The weight of these platforms and their attendant cages, cable winches and the like makes them difficult to move, and require specific overhead fixings. All suspended objects will tend to "wind up" in oscillation under wind loading. The massive nature of the platforms makes the oscillation difficult to control.

Harness arrangements provide limited tool carrying capacity, limited lateral scope, and lack of stability as a work platform.

Safety nets are usually tensioned beneath a primary working arrangement and function as a secondary safety measure for the rope access technicians ("RATS"). The net is an engineered structure comprising spaced ropes or cables tensioned through respective spaced pockets provided in a rope mesh net. The ends of the net between the pockets are provided with a peripheral tensioning rope or wire, each end usually being tied off or shackled to the rigging ends of the respective rope or cable. Safety nets are not suitable as primary work platforms or surfaces because of excess sagging, although they are relatively easy to rig.

SUMMARY OF THE INVENTION

In one aspect the present invention resides broadly in a rigging deck module including:

a deck body including flexible deck material bounded by a web-reinforced tensile edge, suspension means spaced about the edge whereby the deck body is tensionable to form a substantially flat deck surface, and a lattice of tensile web members secured to the flexible deck material and the web-reinforced tensile edge;

tensile rigging strops adapted to be mounted in tension to a structure and maintained in spaced relation to each other, and each having securing points formed thereon; and tensionable connection means located at each suspension means for securing and tensioning the deck body to respective securing points.

The deck body may comprise a bonded arrangement such as high tensile polymer film or fibre or carbon fibre tapes sandwiched between layers of film or fabric. Alternatively the deck body may comprise a stitch-and-glued and/or thermally welded assembly of polymer film or polymer web or mesh, where the webbing lattice is entrapped in pockets.

The webbing may be natural or synthetic fibre webbing including but not limited to webbing of natural fibre, polyester, polyaramid, fibreglass or carbon fibre. The intersection points of the webbing may be stitched or bonded or both.

The flexible deck material may be selected from commercial grades of mesh or fabric such as that used for filtration or shade sails. For example, the flexible deck material may be a relatively stiff, flat PVC coated industrial mesh. The flexible deck material may be selected to enhance the inherent resistance to stretch of the lattice of tensile web members.

The plurality of suspension means describes a polygonal tensioned deck surface. The polygon will be at least a triangle and is preferably a rectangular shape. It is envisaged that any number of suspension means may be used to form polygonal shapes up to an approximation of a circular shape. For example, wherever elements of the lattice intersect the periphery there is potential for a suspension means. In the case of relatively long rectangular shapes, there are preferably provided intermediate suspension means. For example, for a given end length L of a deck body, intermediate suspension means may be provided along the side edges of the deck at, for example, 1.5-2.0 L spacing.

The suspension means are preferably reinforced to provide for secure mounting of the tenslonable connection means.

The tensile rigging strops may be selected from high-tensile, low stretch media such as one or more of wire rope, chain, low stretch webbing or braided line such as SPECTRA® or other polyaramid or polyester braid. The choice of the tensile rigging strops and the means of securing them to the structure will be determined at least in part by the structure itself. In the case of offshore oil rig platforms and like structures it is envisaged that the tensile rigging strops will be permanently or removably installed to tensioning lugs or structure formed on the platform legs or cross members. The tensile rigging strops each may be a single length or alternatively may include discrete securing points for the deck bodies. For example, the tensioned mounting members may be formed with high tensile rings to which selected ones of the tensioning means may be secured.

The spaced relation of the rigging strops may be maintained by any suitable means. For example, where the relevant pair of respective securing points will be close to the fixed structure, the spacing will be maintained by the structure. However, when the rigging strops are distant from the fixed structure, such as interposed in extended tension members, then the spacing may be maintained by compression struts disposed between the spaced rigging strops.

The compression strut may be disposed between the spaced rigging strops at the ends of the deck and having the ends of the strut shackled or otherwise affixed between the pair of securing points securing an end of the deck. The compression strut may be a fixed or adjustable strut. The compression strut may be tubular. For example the tube may be of a heavy-wall, high strength aluminium alloy such as 75 mm OD by 7.0 mm wall, tempered 6061 alloy tube. The tube may be fabricated to suitable end pieces. The end pieces may include high strength mounting means. For example, the end pieces may be fabricated in stainless steel. The end pieces may include a horizontal pivot to allow the strut to find an equilibrium position in use.

The tensionable connection means located at each suspension means for securing the deck body to a respective securing point on the rigging strop structure may include a winch arrangement for providing the tension. Preferably the winch arrangement is located at the deck body so final tensioning can be done from the rigging deck. For example the rigging deck may include a mounting for a load strap ratchet winch, the strap of which may be adapted to be secured to a rigging cable from which the rigging deck is to be deployed. The tensionable connection may be terminated by fixed or removable means. For example, the connection may be by conventional rigging links such as carabiner.

The mounting base may be secured to webbing integral with the deck body and disposed generally in line with the tensioning direction. The mounting base may for example comprise a pair of metal plates bolted together to capture the deck body at the suspension point. The mounting base is preferably of a metal that is strong relative to its weight. For example the mounting base may be of titanium or of an aluminium alloy such as 6061 plate, preferably tempered.

The winch arrangement may be secured to the mounting base by any suitable means. For example, the winch arrangement may be secured to the mounting base by a swivel pin or bolt to enable alignment of the winch tension with the centre of effort on the deck.

Apart from the optional compression strut, there may be provided one or more spreader bars disposed between the spaced rigging strops intermediate the ends of the deck and having an end located between an adjacent pair of intermediate suspension points. The spreader bar may be captured to the rigging strop by common attachment with a supplementary link connecting the deck body to the rigging strop.

The spreader bar may be a fixed or adjustable strut. Typically the spreader bar operates in compression. The disposition of the spreader substantially in the plane of the rigging deck means that the spreader bar is preferably of a material having a high transverse strength with light weight. For example the spreader bar may be of a heavy-wall, high strength aluminium alloy such as 75 mm OD by 7.0 mm wall, tempered 6061 alloy tube. The spreader bar may be captured to the tensioned rigging struts by shackling or other attachment to the securing points for intermediate suspension means.

The tempered tube may be fabricated to suitable end pieces with high strength mounting means. For example, the end pieces may be fabricated in stainless steel. The end pieces may be secured to the deck body by any suitable means and may include terminal attachments for carabiners or the like for supplementary attachment to cables or the like. The end pieces may include a horizontal pivot to allow the spreader to find an equilibrium position in use.

Rectangular decks present a particular form of the present invention and may be configured for particular purposes. Rectangular deck bodies may be adapted to be deployed in end to end relation. In one preferred embodiment the lattice of webs comprising the body may include a pair of peripheral edge portions interconnected by a plurality of spaced, transverse web portions. The transverse web portions interconnecting the ends of the peripheral edge portions may form a continuous peripheral tensile web with the peripheral edge portions.

The deck body may include one or more medial webs parallel to and spaced from the peripheral edge portions and interconnecting each of the transverse web portions. Each of the four corners of the rectangular deck portion may provide a suspension means having tensionable connection means. The ends of the medial web may be configured to accept joining plates to secure the decks in end to end relation, or mount a tensionable connection means if at the end of run. The medial web may be provided with additional suspension points whereby stabilizing lines may be attached from below or overhead. The additional suspension points may be located at the intersections of the medial web and the transverse web portions.

A compression strut may be shared between adjacent decks in end to end relation. The respective rigging strop end securing points may be secured to the respective end fitting of the preferred compression strut, the common attachment formed thereby also attaching the tensionable connection means.

There may be provided a webbing load distributor extending from the suspension means to a distributor point on the medial web away from the peripheral transverse web portions. For example for a substantially symmetric deck the distributor point may be about 25% of the medial web length away from the peripheral transverse web portion. Both webbing load distributors of the suspension means at an end of the deck may share a common distributor point.

BRIEF DESCRIPTION OF THE DRAWINGS

The invention will be further described with reference to preferred embodiments of the present invention, and wherein.

DESCRIPTION OF AN EMBODIMENT

Figure 1:
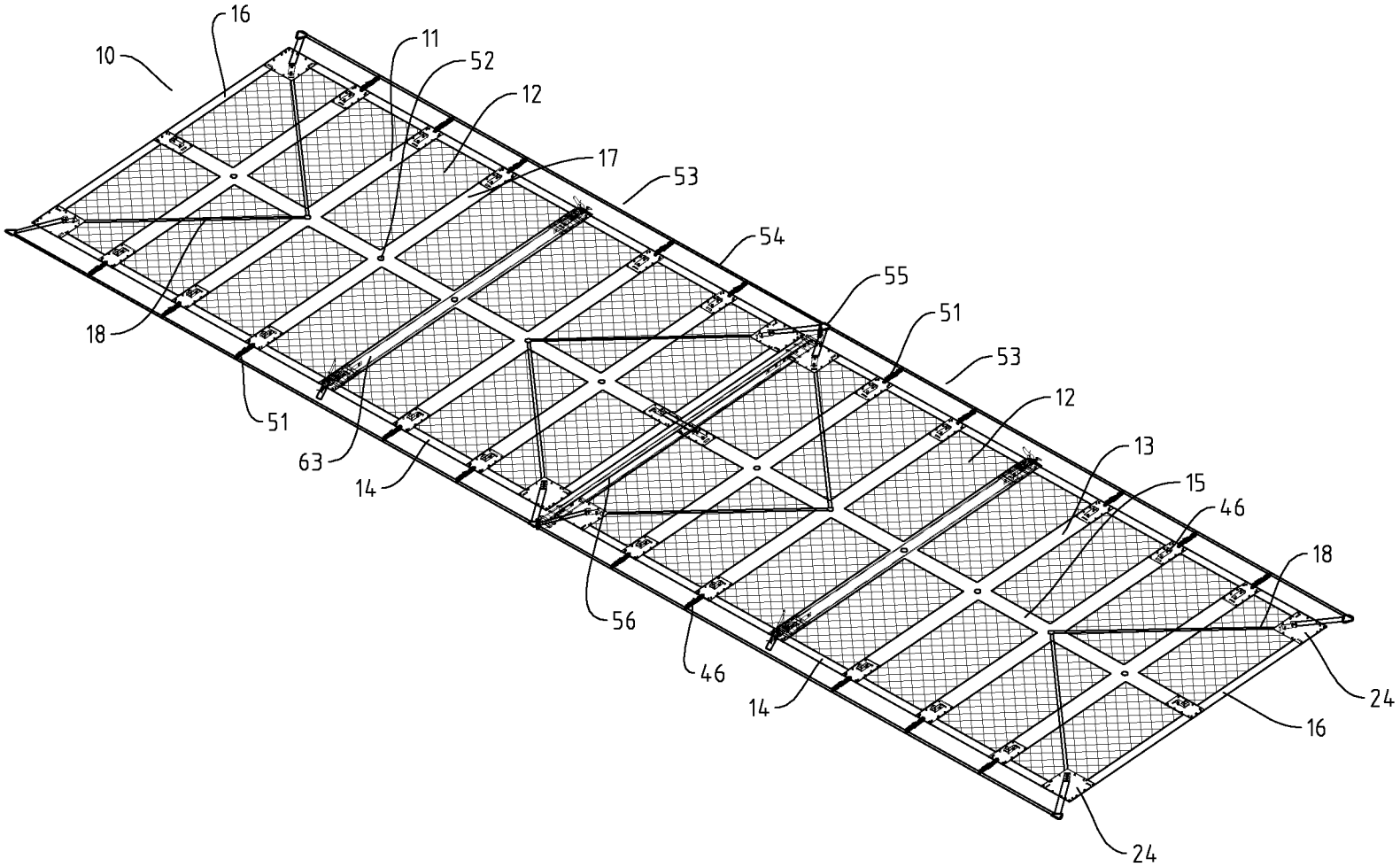
FIG. 1 is a perspective view of a modular rigging deck using deck modules in accordance with the present invention.
Figure 2:
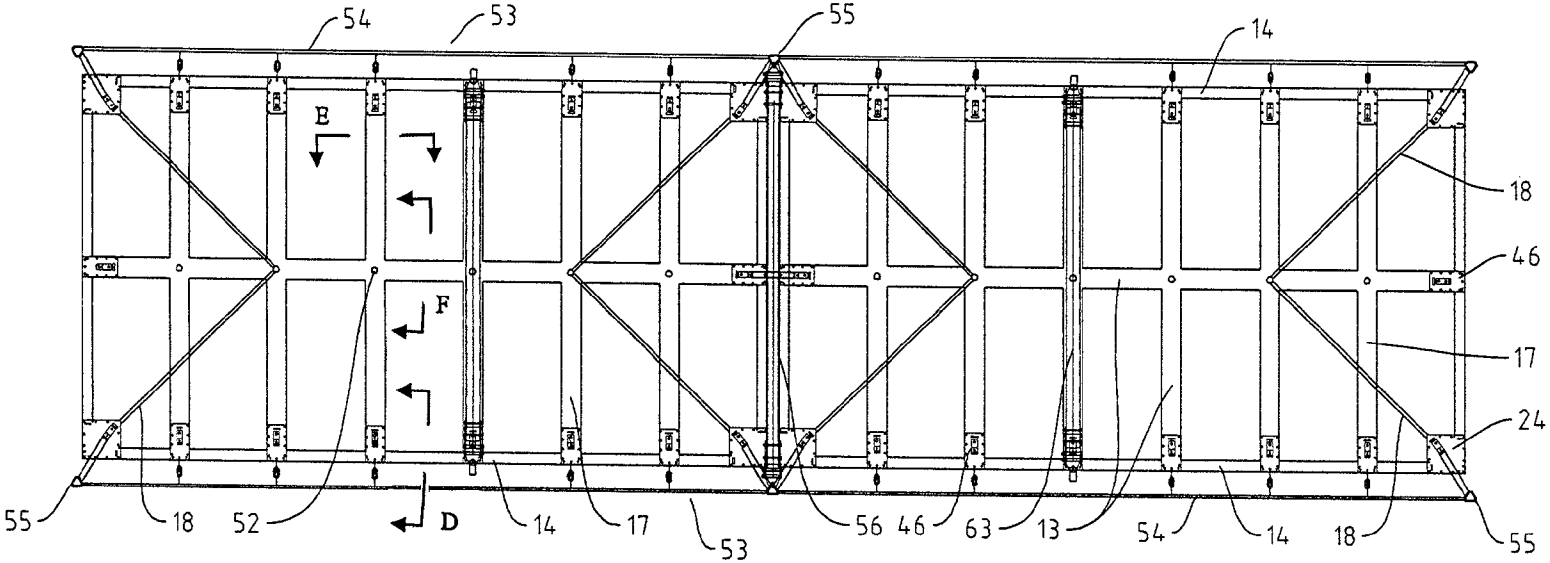
FIG. 2 is a detail plan view of the apparatus of FIG. 1.
Figure 3:
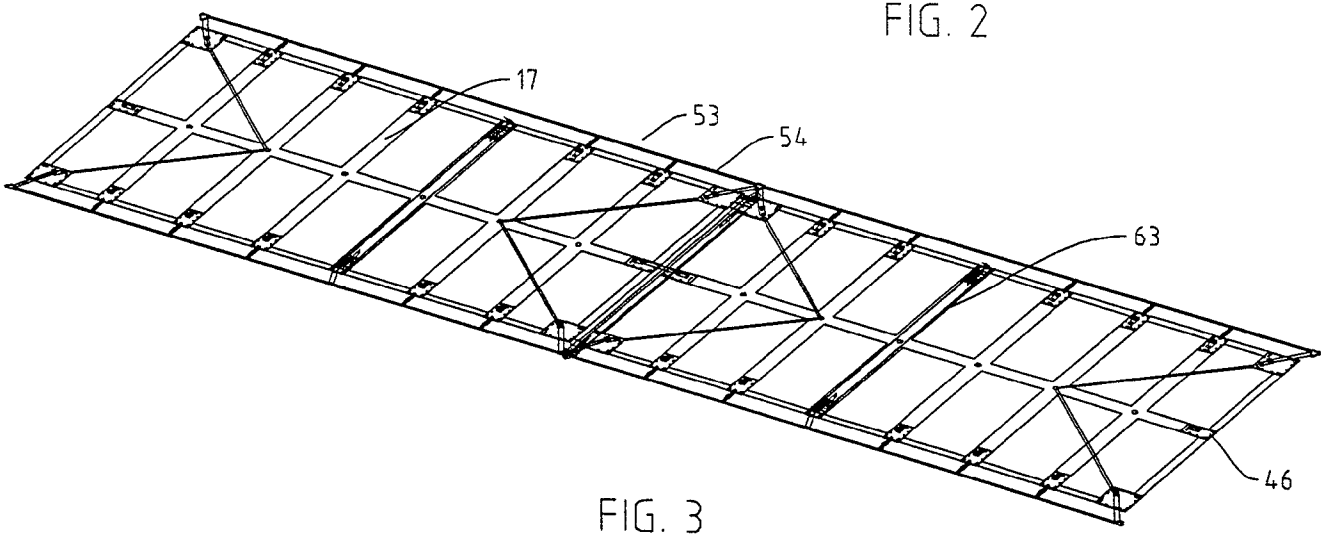
FIG. 3 is a detail perspective view of the apparatus of FIG. 1.

In the Figures there is provided a rigging deck module in an assembly of two to form a rigging deck including deck bodies 10, each comprising a webbing lattice 11 and an industrial PVC mesh deck surface member 12. The lattice 11 is formed by assembly from 50 mm wide, low-stretch, high modulus webbing 13 rated to 2500 kg and comprising respective edge stringer 14 and medial webbing 15 interconnected by end webbing members 16 and transverse webbing members 17. Distributor webbing members 18 extend from the region of the corners and are secured to the medial webbing 15. The lattice 11 is secured to the deck surface members 12 by pocketing with 1000 g/m$^2$ PVC pockets 20 secured by thermal welds 21 to the deck surface members 12.

Figure 9:
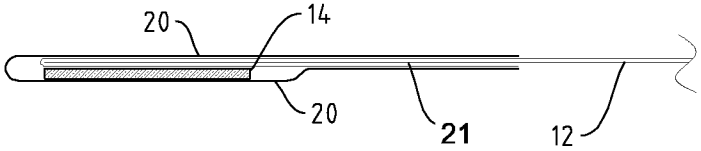
FIG. 9 is a detail view of the deck body edge construction through section D of FIG. 2.
Figure 10:
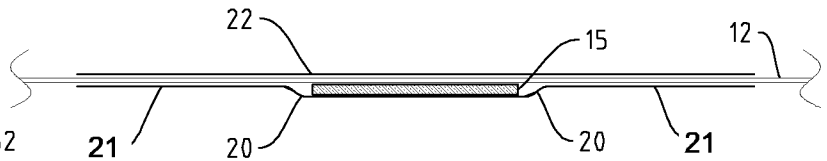
FIG. 10 is a detail view of the deck body construction through section E of FIG. 2.
Figure 11:
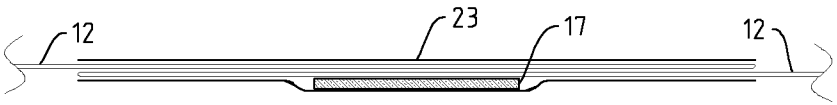
FIG. 11 is a detail view of the deck body construction through section F of FIG. 2.

In FIG. 9 the deck surface member 12 is doubled over the upper surface of the edge stringer 14 and the joint is encapsulated by a 75 mm wide 1000 g/m$^2$ PVC pocket 20 secured top and bottom by 50 mm thermal welds 21. In FIG. 10 the deck surface member 12 is laid up to the medial webbing 15 and the webbing 15 is encapsulated by a 165 mm wide band of 1000 g/m$^2$ PVC forming a 85 mm pocket 20 secured at both sides by 50 mm thermal welds 21. A further 185 mm wide reinforcing band 22 of 1000 g/m$^2$ PVC is thermally welded to the opposite side of the deck surface member 12. In FIG. 11 respective deck surface members 12 are joined by overlapping at a transverse webbing member 17. The webbing 17 and overlap is encapsulated by a 165 mm wide band of 1000 g/m$^2$ PVC forming a 65 mm pocket 20 secured at both sides by 50 mm thermal welds 21. A further 165 mm wide reinforcing band 23 of 1000 g/m$^2$ PVC is thermally welded to the opposite side of the overlap.

Figure 6:
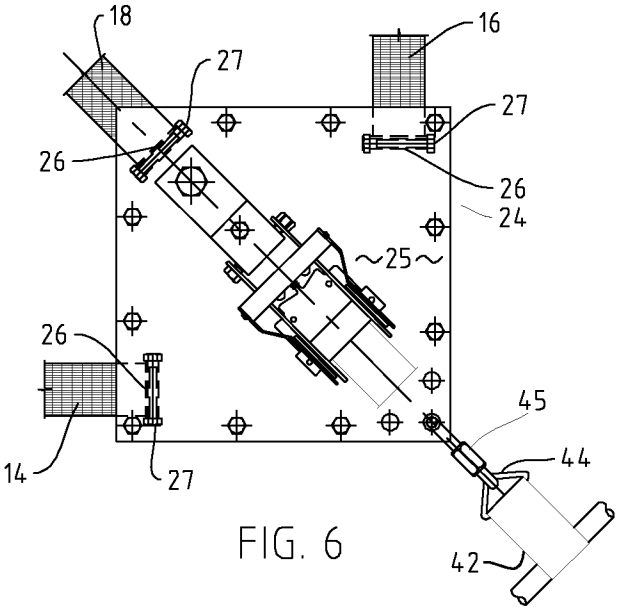
FIG. 6 is a detail plan view of tensionable connection means located at a suspension means for use in the apparatus of FIG. 1.
Figure 7:
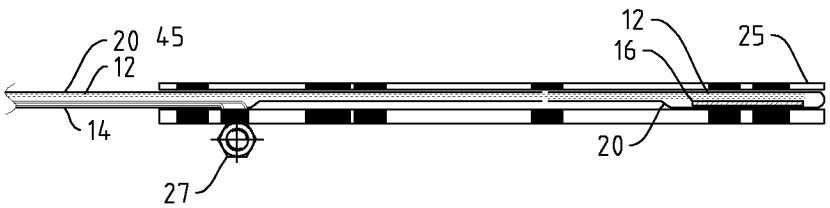
FIG. 7 is a fabric clamping detail of assembly of the apparatus of FIG. 1.

Corner suspension means 24 are provided as illustrated in FIG. 6, and comprise a pair of corner plates 25 bolted together and entrapping the corner of the deck surface member 12 and the ends of the edge stringer 14 end webbing members 16. The lower plate of the corner plates 25 is typically 6 mm 6061 alloy, T6 tempered and has three 55 mm slots 26 formed therein. Each slot 26 is adapted to receive a bight of a respective one of the 50 mm edge stringer 14, end webbing member 16 and distributor webbing member 18, the bight being retained against withdrawal by M10 retainer bolt 27 to positively terminate and transfer tensile loads from the webbing 14, 16 and 18 to the plate 25.

The corner suspension means 24 supports a tensionable connection means comprising a ratchet strap winch assembly 30. The winch assembly 30 includes a swivel plate 31 pivoted to the corner suspension means 24 by M16 swivel bolt 32. A winch body 33 is pivotally mounted to a swivel lug 34 formed on the swivel plate 31 via horizontal pivot bolt 35 and retained by M10 retainer bolt 36. The winch handle 37 acts on a spindle 38 via drive pawl 40 and ratchet wheel 41 to tension load binder webbing 42 spooled onto the spindle 38. The spindle 38 is retained against unspooling of the tension load binder webbing 42 between handle strokes by pawl 43. A 2:1 mechanical advantage in tensioning force is provided by the end of the tension load binder webbing 42 being terminated by terminal loop 44 and carabiner 45 to the corner plates 25.

Figure 4:
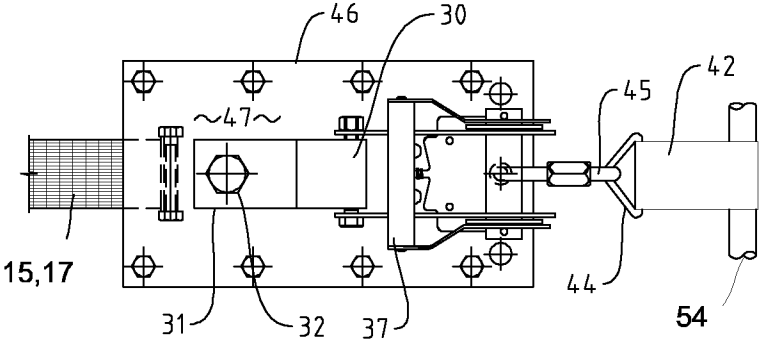
FIG. 4 is a detail plan view of tensioning means for use in the apparatus of FIG. 2.
Figure 5:
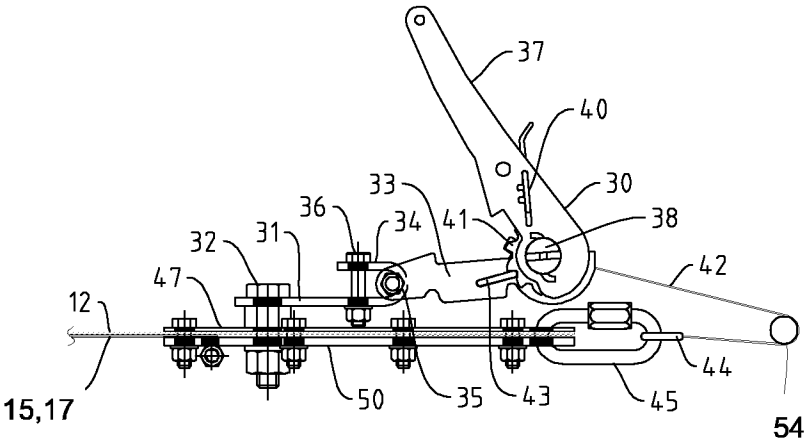
FIG. 5 is an elevation view of FIG. 4.

Similarly, supplementary suspension means 46 as illustrated in FIGS. 4 and 5 includes a 3 mm 6061-T6 alloys upper plate 47 and a 6 mm lower plate 50 of the same material, bolted together and entrapping the deck surface member 12 and the peripheral end webbing 16 or edge stringer 14 omitted for clarity). The lower plate 50 has a 55 mm slot 26 formed therein adapted to receive a bight of the respective medial webbing member 15 or transverse webbing member 17, the bight being retained against withdrawal by M10 retainer bolt 27 to positively terminate and transfer tensile loads from the webbing 15, 17 to the plates 47, 50.

The supplementary suspension means 46 may selectively mount a tensioning means comprising a ratchet strap winch assembly 30 as before. Otherwise, the supplementary suspension means 46 may be a static suspension point for securing to a substrate or to rigging strops by means such as a carabineer 51.

The intersections of the medial webbing member and the transverse webbing members are provided with attachment hales 52 permitting selective stay attachment from above or below.

Rigging strops 53 comprise steel wire cable 54 swaged to high tensile rings 55 forming securing points for the deck bodies. The rigging strops 53 are tensioned in mutually spaced relation to a structure (not shown). In the illustrated embodiment, rigging strops 53 are strung together to form a two-deck arrangement. The tension load binder webbing 42 passes through the rings to be terminated by terminal loop 44 and carabineer 45 to the corner plates 25 or supplementary suspension means 46 as the case requires.

Figure 8:
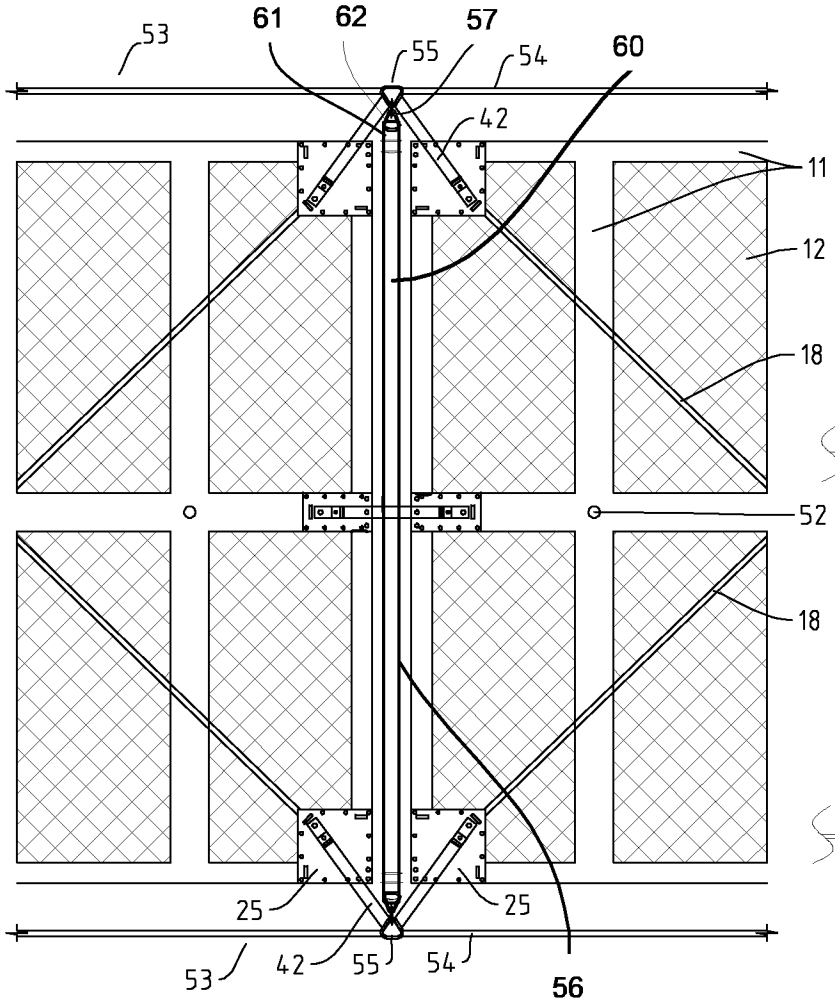
FIG. 8 is a detail plan view of the connection between adjacent deck assemblies.

As illustrated in detail in FIG. 8, a compression strut 56 is disposed between the spaced rigging strops 53 at the ends of the deck bodies 10 and having the ends of the strut 56 affixed by carabineer 57 to the rings 55. The compression strut 56 is formed of 75 mm OD by 7.0 mm wall, tempered 6061 alloy tube 60 fabricated to stainless steel end pieces 61. The end pieces 61 include a horizontal pivot 62 to allow the strut to find an equilibrium position in use. Similar spreaders 63 are disposed intermediate the ends of the deck body 10.

The rigging deck of the above embodiment is a tensioned platform which is a primary support for work to replace aluminium scaffold, but used in a similar way to aluminium scaffold and also may be used where scaffolding has no access. The platform is versatile. Strength and minimal deflection are advantages. Whereas a safety net would deflect approx 1 m to 1200 mm, a deck in accordance with the present invention will only deflect 200 mm-400 mm with an applied weight of 250 kilo per square metre, approximating a semi rigid floor.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

The invention claimed is:

1. A rigging deck module including:

a deck body including an assembly of polymer film or polymer web and a flexible deck material bounded by a web-reinforced tensile edge comprising edge stringers interconnected by end webbing members, four corners formed by each of the end webbing members interconnecting the ends of the edge stringers each provide a corner suspension means, supplementary suspension means spaced about the web-reinforced tensile edge whereby the deck body is tensionable to form a substantially flat deck surface, a lattice of tensile web members entrapped in pockets and secured to the flexible deck material and the web-reinforced tensile edge, a medial web parallel to and spaced from the edge stringers and interconnecting each of the end webbing members, and, a webbing load distributor included on each of the corner suspension means extending from a suspension point to a distributor point on the medial web 25% of the medial web length away from the suspension point;

tensile rigging strops adapted to be mounted in tension to a structure and adapted to be maintained in spaced relation to each other by tubular compression struts disposed between each of the tensile rigging strops, and each of the tensile rigging strops having securing points formed thereon, ends of each of the tubular compression struts shackled or otherwise affixed between a pair of securing points securing an end of the deck body;

one or more spreader bars disposed between each of the tensile rigging strops and captured to each of the tensile rigging strops by common attachment with a supplementary link connecting the deck body to each of the tensile rigging strops and formed from tempered tube having end pieces with terminal attachments for carabineers, the end pieces including a horizontal pivot to allow each of the spreader bars to find an equilibrium position in use; and tensionable connection means located at each of the corner suspension means for securing and tensioning the deck body to respective securing points of said securing points and including a winch arrangement for providing the tensional, the winch arrangement including a mounting base secured to webbing integral with the deck body by a swivel pin or bolt and disposed generally in line with the tensioning direction and supporting a load strap ratchet winch, a strap of which being adapted to be secured to each of the said tensile rigging strops.

2. A rigging deck module according to claim 1, wherein the assembly of polymer film or polymer web is stitched-and-glued and thermally welded.

3. A rigging deck module according to claim 1, wherein intersection points of said lattice and said web-reinforced tensile edge form the corner suspension means and said supplementary suspension means.

4. A rigging deck module according to claim 3, wherein said corner suspension means and said supplementary suspension means are reinforced to provide for secure mounting of the tensionable connection means.

5. A rigging deck module according to claim 1, wherein the tensile rigging strops are selected from one or more of wire rope, chain, low stretch webbing and low stretch braided line.

6. A rigging deck module according to claim 5, wherein the tensile rigging strops include discrete securing points for the deck body.

7. A rigging deck module according to claim 1, wherein the deck body is rectangular.

8. A rigging deck module according to claim 7, wherein ends of the medial web are configured to accept joining plates to secure the deck in end to end relation to an adjacent rigging deck module, or to mount the tensionable connection means.

* * * * *